US006695237B2

(12) United States Patent
Steinier

(10) Patent No.: US 6,695,237 B2
(45) Date of Patent: Feb. 24, 2004

(54) TEST MILL

(75) Inventor: Philippe Steinier, Mosman Park (AU)

(73) Assignee: Magotteaux International, Vaux-sous-Chevremont (BE)

( * ) Notice: Subject to any disclaimer, the term of this patent is extended or adjusted under 35 U.S.C. 154(b) by 152 days.

(21) Appl. No.: 10/041,358

(22) Filed: Jan. 8, 2002

(65) Prior Publication Data

US 2002/0104910 A1 Aug. 8, 2002

(30) Foreign Application Priority Data

Jan. 18, 2001 (BE) ..... 2001/0046

(51) Int. Cl.[7] ..... B02C 17/16
(52) U.S. Cl. ..... 241/36; 241/65; 241/70
(58) Field of Search ..... 241/36, 65, 70, 241/176, 299, 33, 38

(56) References Cited

U.S. PATENT DOCUMENTS 3,527,419 A * 9/1970 Wienert ..... 241/153
4,726,531 A * 2/1988 Strasser ..... 241/19
5,007,589 A * 4/1991 Evans et al. ..... 241/21
5,524,830 A * 6/1996 Murase et al. ..... 241/172

* cited by examiner

*Primary Examiner*—Allen Ostrager
*Assistant Examiner*—Shelley M Self
(74) *Attorney, Agent, or Firm*—Leydig, Voit & Mayer, Ltd.

(57) ABSTRACT

The test mill is a reduced-scale model of an industrial mill used in the mining industry and comprising a rotary shell (10) capable of rotating about its longitudinal and horizontal axis. This shell is capable of containing a certain amount of grinding media and of receiving a certain amount of material to be ground so as to be able to operate under conditions comparable with those of an industrial mill. The shell is divided, in the longitudinal direction, by a perforated transverse partition (24), into a grinding chamber (20) and a measurement chamber (22), the perforations in the partition being sized to hold the grinding charge back and allow the ground matter to pass through, whereas the shell (10) comprises a series of injectors (28) allowing fluid products to be injected into the grinding chamber (20). It is possible to make in-situ and continuous analyses of the pulp in the measurement chamber.

5 Claims, 1 Drawing Sheet

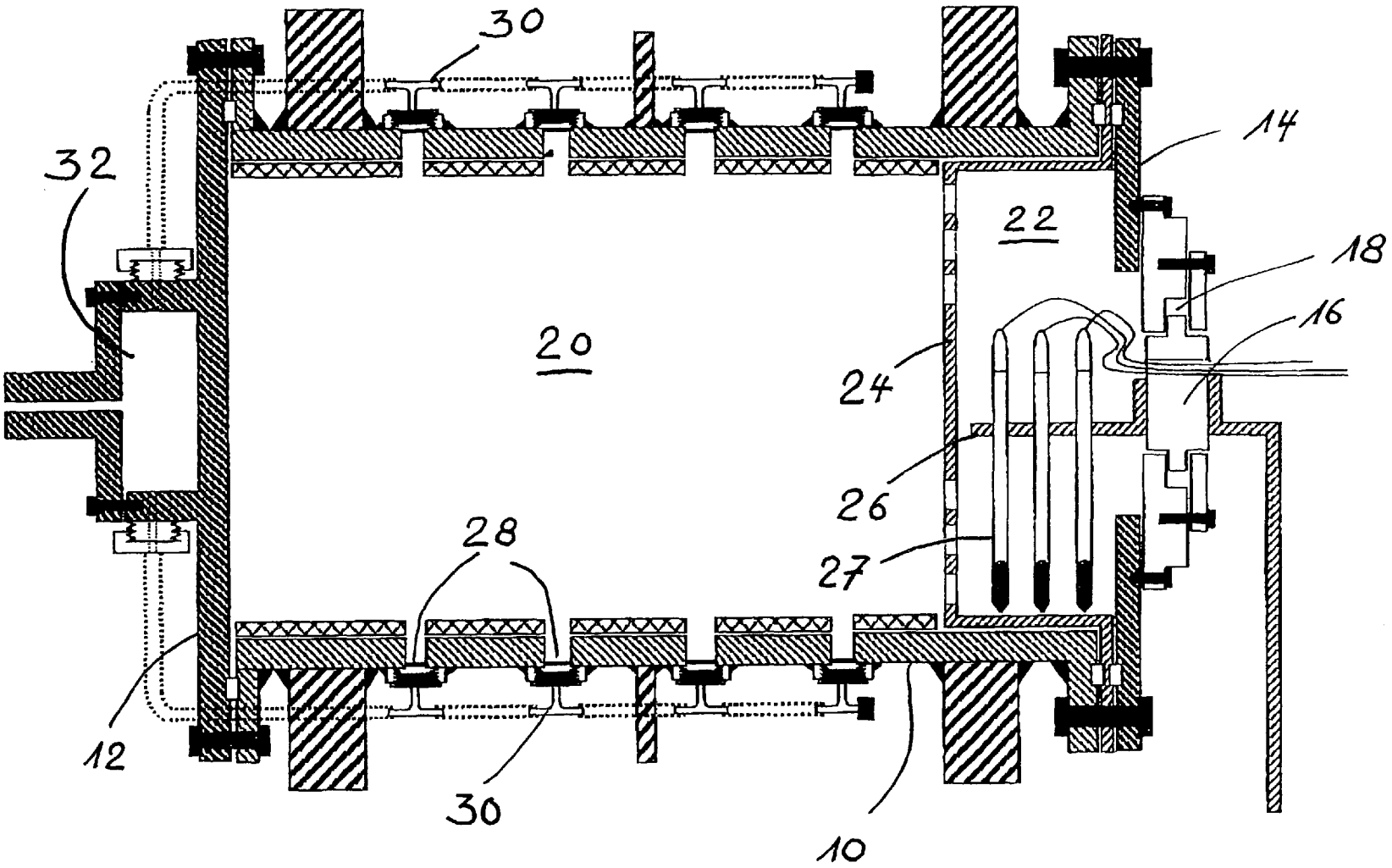
14
18
16
22
24
26
27
10
20
30
28
30
32
12

TEST MILL

FIELD OF THE INVENTION

The present invention relates to a test mill forming a reduced-scale model of an industrial mill used in the mining industry and comprising a rotary shell supported by a frame and capable of rotating, at a variable speed, about its longitudinal and horizontal axis, said shell being capable of containing a certain amount of grinding media and of receiving a certain amount of material to be ground so as to be able to operate under conditions comparable with those of an industrial mill.

BACKGROUND OF THE INVENTION

The invention is aimed more particularly at the field of wet milling, particularly as used in the mining industry to grind ores such as iron ore or copper ore for example. These mills contain a grinding charge compriseing of grinding media such as balls, cylpebs, boulpebs, bars, etc. and grinding occurs as the mill rotates under the effect of impact and friction occuring within the grinding charge. The material to be ground is converted into a wet pulp which comprises of the actual mineral, of sterile matter known as "gangue" and of water.

The operation which follows grinding comprises in extracting the valuable mineral from the pulp, that is to say in separating the mineral from the gangue. This operation is performed in a flotation cell. This is a tank in which there is a stirrer to agitate the pulp and which calls upon surface-tension phenomena. Gases and chemical reagents are injected into the liquid medium to make the mineral spaces hydrophobic. The mineral with hydrophobic surfaces bind to the gas-liquid interface of the gas and air bubbles. These bubbles thus harvest the mineral by rising to the surface where they resemble a mineral-rich froth which is removed by overflowing.

The yield of a flotation cell, particularly the rate of recovery of the valuable mineral is directly influenced by the pulp chemistry and the state of particle surface which, in turn, depends on the mill operating conditions and on the nature of the grinding media. Furthermore, the chemical composition of the pulp may have a beneficial or detrimental effect on the consumption of reagents injected into the flotation cell.

It will therefore be appreciated that it is essential to be able to make regular and frequent survey of the pulp in order to assess the impact of the milling conditions on the pulp chemistry and make a reliable diagnosis of its operating conditions. Unfortunately, at the present time, this type of diagnostic and analysis cannot be performed in the plant and a laboratory investigation presents great difficulties as regards the producibility of the plant situation and as reliability of results e.g. the scale up to the plant of laboratory research results.

Indeed the only method used to date and described in an article published by the researchers of ENSG and CNRS, in International Journal of Mineral Processing, No. 28 (1990) pages 313–337 proposes that a pulp and a chemical environment equivalent to those of an industrial mill to be studied and monitored be recreated in the laboratory.

This method uses a mill in closed circuit with an independent investigation chamber. The pulp is recreated in the investigation chamber then injected into the mill to be ground. After the grinding operation, the pulp is transferred to a flotation cell.

It is clear that during grinding, the composition of the pulp and the atmosphere in the mill change. Now, the atmosphere is of great importance, particularly its oxygen content. In consequence, at the end of grinding, the chemical state of the pulp (and by chemical state we mean not only the composition of the pulp but also the chemical medium in which it moves) has changed and the conditions are no longer intended industrial conditions for carrying out the flotation test.

BRIEF SUMMARY OF THE INVENTION

The object of the present invention is to provide a test mill which makes it possible to recreate the operating conditions of an industrial mill and to perform continuous and in-situ analysis and adjustment of the chemical state of the pulp during the grinding operation without it being necessary to prepare the pulp in advance in an independent chamber.

To achieve this objective, the present invention proposes a test mill of the kind described in the preamble, which is characterized in that the shell is divided, in the longitudinal direction, by a perforated transverse partition, into a grinding chamber and a measurement chamber, in that the perforations in the partition are sized to hold the grinding charge back and allow the ground material to pass through, and in that the shell comprises a series of injectors allowing fluid products to be injected into the grinding chamber.

The shell is preferably supported by a moving chassis to which the two bases are connected by means of a fixed bearing and a rotary joint.

The measurement chamber contains a series of measurement instruments supported by a bracket fixed to the fixed bearing.

The injectors are preferably arranged in several longitudinal rows supplied respectively by supply lines from a buffer chamber provided on the base opposite the measurement chamber and supplied axially with injection fluids through its support bearing.

The pulp formed during the grinding operation in the grinding chamber and which can flow freely through the transverse partition into the measurement chamber can be analysed at will using the measurement instruments during the grinding operation and without interruption thereof. Furthermore, the injectors of gas into the grinding chamber make it possible to adjust and control the chemical state of the pulp.

The mobility of the mill allows it to be moved around on an industrial site where it can operate in parallel with the industrial mill.

Other objectives and advantages of the invention will become more apparent from the following detailed description when taken in conjunction with the accompanying drawings.

BRIEF DESCRIPTION OF THE DRAWINGS

Other specifics and advantages of the invention will become apparent from the detailed description of an advantageous embodiment which is given hereinbelow by way of illustration with reference to the single FIGURE which shows a longitudinal section through a test mill according to the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

The test mill shown in the FIGURE comprises of a cylindrical shell 10 which can rotate about its longitudinal and horizontal axis and which is driven in rotation at variable speed by means, not depicted. The interior lining of the shell may, preferably, be of rubber without or with lifters but could be made of metal or any other material. The shell 10 is closed by two bases 12 and 14 and is carried by a chassis, not shown, preferably on wheels. The shell is connected to the chassis by means of several bearings 16 and rotary joints 18, only those associated with the base 14 being depicted.

The dimensions of the mill may be of the order of 300×300 mm, which makes it possible to process a sufficient amount of ore to produce three to five liters of pulp needed for performing flotation tests.

According to the present invention, the shell is divided by a perforated transverse partition 24 into a grinding chamber 20 and a measurement chamber 22. The perforations in the partition 24 are small enough to hold the grinding media back in the chamber 20 but large enough to allow the pulp to pass through from the grinding chamber 20 into the measurement chamber 22.

Inside the measurement chamber 22 there is a bracket 26 fixed to the bearing 16. This bracket carries measurement instruments 27 which can dip into the pulp. These instruments may be of the type described in the article from the aforementioned document for determining essential properties of the pulp such as its pH, its Eh potential, its temperature and the amount of dissolved oxygen.

According to one specific feature of the mill proposed by the present invention, the shell comprises, at the grinding chamber 20, injectors 28 which allow gases such as oxygen, argon and nitrogen, to be injected into the grinding chamber 20. These injectors 28 are preferably arranged in four horizontal rows at the four cardinal comers of the shell 10. Thus, given the volume occupied by the mass during the grinding operation, two rows of injectors inject the gas into the atmosphere over the pulp and the other two rows inject the gases directly into the pulp. The various rows of injectors 28 are connected by flexible lines 30 to a buffer chamber 32 outside the base 12, which chamber is supplied axially with the chosen gas.

Other elements needed for the operation of the mill, such as the filling or emptying system or even the grinding balls with a maximum estimated diameter of 38 mm have not been depicted in the FIGURE.

For operation, the test mill according to the present invention receives a charge to simulate that of the industrial mill of which it is the model. During grinding in the test mill the chemical state of the pulp is constantly monitored in the measurement chamber 22 and, if necessary, this state is modified by injections of gas into the grinding chamber so as to create a pulp with chemical properties identical to those produced in the industrial mill. As a result, there is knowledge of the operating parameters which allow a pulp of given chemistry identical to that of the pulp of the industrial mill to be sent into the flotation cell.

From this data it then becomes possible to modify various operating parameters of the test mill in order to modify the pulp conditions and observe the effect that this has on the quality of the flotation in terms of the recovery, selectivity of mineral and the consumption of reagents.

For example, it is possible to try out various grinding media of different natures and chemical compositions. Thus, it will be found that certain grades (analyses) of the grinding media produce a better pulp (that is to say one capable of good flotation) than others.

It is also possible to modify the chemistry of the pulp by modifying the injections of gas into the grinding chamber, still with a view, by flotation tests, to finding the optimum chemical state of the pulp and thus discover the grinding parameters that allow this pulp to be achieved. This knowledge and these test results can then be used in the industrial mill to produce a pulp whose chemical properties allow the results of the flotation to be optimized.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. Test mill forming a reduced-scale model of an industrial mill used in the mining industry and comprising a rotary shell (10) capable of rotating, at a variable speed, about its longitudinal and horizontal axis, said shell (10) being capable of containing a certain amount of grinding media and of receiving a certain amount of material to be ground so as to be able to operate under conditions comparable with those of an industrial mill, characterized in that the shell (10) is divided, in the longitudinal direction, by a perforated transverse partition (24), into a grinding chamber (20) and a measurement chamber (22), in that the perforations in the partition are sized to hold the grinding charge back and allow the ground matter to pass through, and in that the shell (10) comprises a series of injectors (28) allowing gas products to be injected into the grinding chamber (20); and wherein the measurement chamber (22) contains a series of measurement instructions supported by a bracket (26) fixed to the fixed bearing (16).

2. Test mill according to claim 1, characterized in that the shell (10) includes two bases (12) and (14, the two bases (12) and (14) of the shell (10) supported by means of a fixed bearing (16) and a rotary joint (18).

3. Test mill according to claim 1, characterized in that the injectors (28) are arranged in longitudinal rows supplied respectively by supply lines from a buffer chamber (32) provided on the base (12) opposite the measurement chamber (22) and supplied axially with injection gases through its support bearing.

4. Test mill according to claim 2, characterized in that the injectors (28) are arranged in longitudinal rows supplied respectively by supply lines from a buffer chamber (32) provided on the base (12) opposite the measurement chamber (22) and supplied axially with injection gases through its support bearing.

5. Test mill according to claim 1, characterized in that the injectors (28) are arranged in longitudinal rows supplied respectively by supply lines from a buffer chamber (32) provided on the base (12) opposite the measurement chamber (22) and supplied axially with injection gases through its support bearing.

* * * * *

UNITED STATES PATENT AND TRADEMARK OFFICE

CERTIFICATE OF CORRECTION

PATENT NO. : 6,695,237 B2
DATED : February 24, 2004
INVENTOR(S) : Philippe Steinier It is certified that error appears in the above-identified patent and that said Letters Patent is hereby corrected as shown below:

Column 4,
Line 43, change "instructions" to -- instruments --

Signed and Sealed this

Fifteenth Day of June, 2004

JON W. DUDAS
*Acting Director of the United States Patent and Trademark Office*